US005386657A

United States Patent [19]

Racheli

[11] Patent Number: 5,386,657

[45] Date of Patent: Feb. 7, 1995

[54] CAPACITY MAGAZINE FOR HANDGUNS

[75] Inventor: Edoardo Racheli, Gardone V.T., Italy

[73] Assignee: MEC-GAR S.r.l., Gardone V.T., Italy

[21] Appl. No.: 93,780

[22] Filed: Jul. 19, 1993

Related U.S. Application Data

[63] Continuation-in-part of Ser. No. 959,667, Oct. 13, 1992, abandoned.

[30] Foreign Application Priority Data

Jul. 17, 1992 [IT] Italy ..... BS/92/A/000089

[51] Int. Cl.[6] ..... F41A 9/65

[52] U.S. Cl. ..... 42/50

[58] Field of Search ..... 42/7, 18, 22, 50; 89/195, 196, 197

[56] References Cited

U.S. PATENT DOCUMENTS 4,539,889 9/1985 Glock ..... 89/147

*Primary Examiner*—Stephen C. Bentley
*Attorney, Agent, or Firm*—McGlew and Tuttle

[57] ABSTRACT

A magazine for firearms is provided with either a double or single row of cartridges. The magazine is particularly for use with automatic or semi-automatic pistols. The magazine includes a magazine housing for ammunition having a magazine housing bottom. A follower and spring are provided within the magazine housing for moving the cartridges upward away from the bottom. The follower is provided with a curved upper edge with a radius larger than the radius of the cartridges or ammunition. This curved upper edge connects with a curved top tapered edge of the follower to form an inclined upper side. The base of the follower has an inclined surface and a cavity for receiving coils of the spring. A wall of the cavity and the inclined side meet at an edge of the inclined surface at a beveled region. The magazine spring has an upper taper part that fits snugly into the cavity or notch of the follower when the magazine is fully loaded with ammunition.

9 Claims, 2 Drawing Sheets

106

106

104

TAPERED COILS
13a
13b

B
100
13c
STIFFENING FOLDS
102

CAPACITY MAGAZINE FOR HANDGUNS

This is a continuation-in-part application of application Ser. No. 07/959,667 filed Oct. 13, 1992, now abandoned.

FIELD OF THE INVENTION

This invention generally relates to the field of firearms, with particular reference to automatic or semi-automatic pistols and their magazines as well.

BACKGROUND OF THE INVENTION

Pistol magazines are normally made up of a magazine tube or magazine housing, a follower which supports the ammunition in the magazine housing and lines it up, a magazine spring that gradually raises the follower and the ammunition for feeding the gun when it is operating, a floorplate and a floorplate holder.

In conventional magazines, the presence of the follower and the spring of the known shape and design, requiring space to be fully compressed when the magazine is fully loaded, normally reduces the actual capacity of the magazine. Such conventional magazines, with the same dimensions and under the same conditions, cannot contain more than a set amount of ammunition.

On the other hand, there is the need for automatic and semi-automatic pistols and other handguns to be provided with increased firing power with respect to the firing power of the conventional magazines.

SUMMARY AND OBJECTS OF THE INVENTION

It is an object of the invention to meet this specific requirement by increasing the magazine capacity while maintaining the same overall outside dimensions of conventional magazines.

This invention aims to provide a large capacity magazine to increase the autonomy of the firearm in which it is fitted, and to be fully interchangeable with a standard magazine fitted to the firearm that has the same general shape, length and width.

According to this invention, the magazine has also been perfected as regards the follower, the magazine spring and the magazine tube or magazine housing, so as to better use the internal ammunition space and reduce the amount of space occupied by the follower and the magazine spring when, with the magazine fully loaded, the spring is closely compressed between the follower and the bottom of the magazine.

It should be noted that this invention may be applied to both staggered magazines, i.e. with the ammunition arranged in two rows, and single row magazine, i.e. with ammunition arranged in one row, depending on the type of pistol on which the magazine is to be fitted.

This invention can be applied to advantage to most of the pistols currently available on the market, of various makes equipped with either double or single column magazines, although the description below refers to a staggered magazine.

According to the invention, the magazine for firearms is provided with either a double or single row of cartridges. The magazine is particularly for use with automatic or semi-automatic pistols. The magazine includes a magazine housing for ammunition having a magazine housing bottom; the magazine housing without projections at the base on the two larger sides is provided with a flat surface which has been cut off from the sharp edge of the two guide ribs in the upper part of the tube. A follower and spring are provided within the magazine housing for moving the cartridges upwardly away from the bottom. The follower is provided with a curved upper edge with a radius larger than the radius of the cartridges or ammunition. This curved upper edge connects with a curved top tapered edge of the follower to form an inclined upper sidewall which is provided with a projection of the catch which better interacts with the hold open of the gun. The base of the follower has an inclined surface and a cavity with an inside bevel for receiving some coils of the spring. A wall of the cavity and the inclined upper sidewall meet at an edge of the inclined surface edge at the beveled region. The magazine spring has either an upper tapered part or two sections and fits snugly into the cavity or notch of the follower when the magazine is fully loaded with ammunition. It has reinforced coils with stiffening folds and wider pitches.

It is a further object of the invention to provide a handgun magazine for cartridges which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 2:
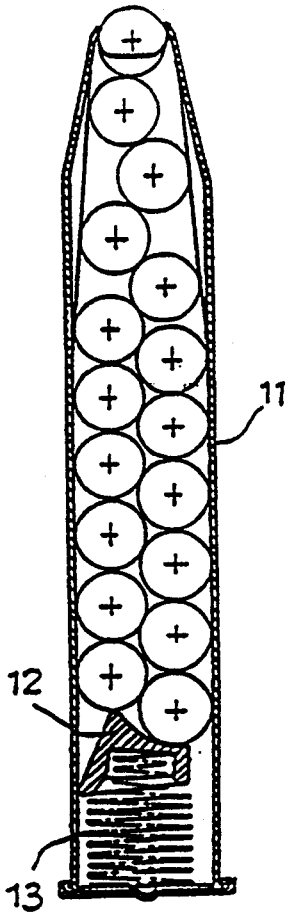
FIG. 2 is a view similar to FIG. 1 of the magazine fully loaded with ammunition.
Figure 4:
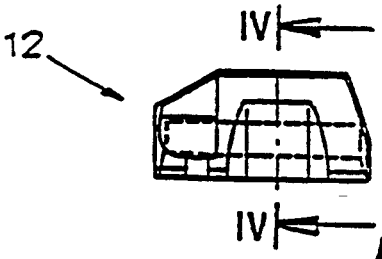
FIG. 4 is a side view of the follower according to the invention.
Figure 4A:
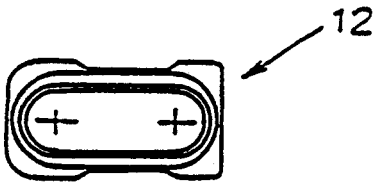
FIG. 4*a* is a top view of the follower of FIG. 4.
Figure 4C:
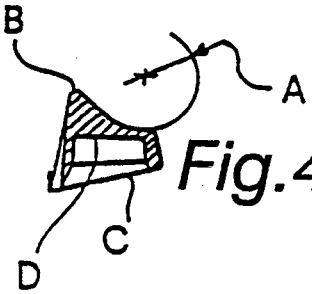
FIG. 4*c* is a cross sectional taken along line IV—IV of FIG. 4.
Figure 4B:
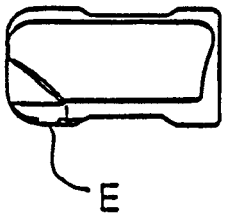
FIG. 4*b* is a bottom view of the follower of FIG. 4.

The magazine covered by this invention includes a tube or magazine housing 11 defining a chamber. A follower 12 is provided which can be moved inside the magazine housing 11 and a magazine spring 13 is disposed between the bottom of the magazine housing 11 and the follower 12. The spring 13 is fully compressed when the magazine is fully loaded (see FIG. 2). The spring 13 moves the follower upwards as the ammunition is used.

As already mentioned above, the aim of this invention is obtained by modifying the follower 12, the magazine spring 13 and the tube 11.

According to the invention, the follower 12 is preferably made of either plastic material of pressure-die-cast or micro-die-cast metal alloy, with extremely reduced dimensions, but whose shape has been designed, as shown in FIGS. 4–4*a*–4*b* and 4*c* to ensure the absolute reliable loading of the magazine and positive feeding.

The follower 12 has a top edge A with a wider radius R than normally used (a larger radius than the radius of the cartridges). This structure reduces lateral thrust of ammunition inside the magazine tube when loading the magazine and during the feeding. This structure also provides additional space in the housing 11 for cartridges. The follower 12 has a top tapered edge B to facilitate the travel of the follower 12 (the traverse of the follower) according to the change of the inside sectional area of the magazine housing 11. This enables the follower to assume the right rotated position, in order to prevent it from jamming when the magazine is being loaded or unloaded. The follower 12 has a lower inclined surface C to reduce the amount of space occupied by the follower when it is rotated to some degree at the end of its downward stroke with the magazine fully loaded (see FIG. 2). In this way, the space below the follower can receive the maximum number of compressed spring coils.

The follower 12 also is provided with a notch or cavity D which houses the top end of the spring 13. This notch D is suitably oriented to enable the spring to exert its thrust action optimally against the ammunition row over the follower along its vertical stroke. The notch D is deep enough to receive some coils (appropriately dimensioned as discussed below) of the magazine spring 13. The follower 12 is provided with a bevel H (see FIG. 4*c*) into the notch D to enable the spring 13 to self-center into the follower when it is compressed. The bevel enables the follower to hold some conical coils (appropriately dimensioned as discussed below) of the spring 13. The follower 12 is also provided with a projection of the catch E of the slide-stop lever to ensure more reliable performance.

Figures 5A, 5B, 5C, 5D, 5E, 5F:
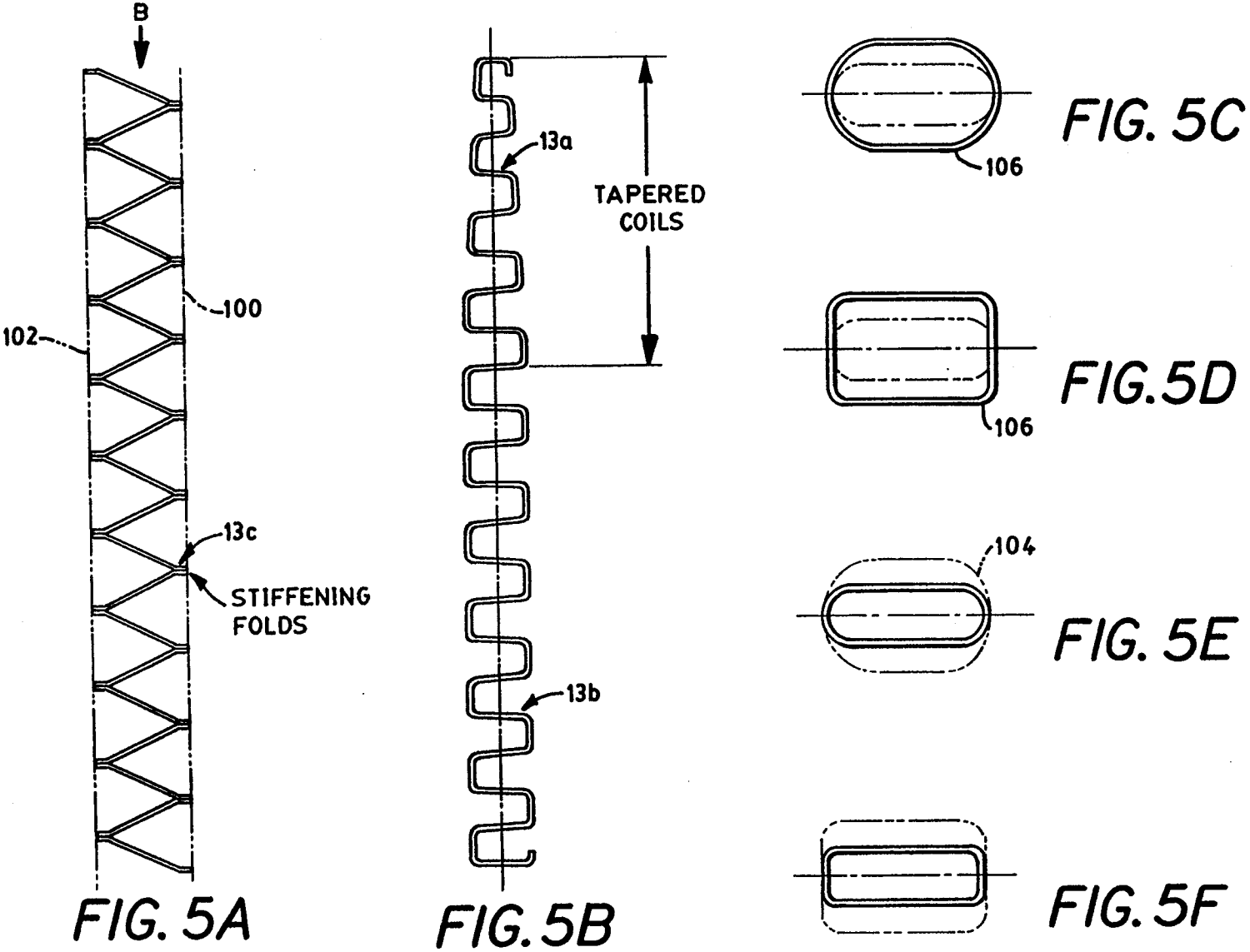
FIG. 5*a* is a front view of an extended spring according to the invention.
FIG. 5*b* is a side view of the extended spring according to FIG. 5*a;*
FIG. 5*c* is a bottom view of the spring of FIG. 5*a* having an oval shape.
FIG. 5*d* is a top view of the spring of FIG. 5*a* with a rectangular shape.
FIG. 5*e* is a bottom view of the spring of FIG. 5*a* having an oval shape.
FIG. 5*f* is a top view of the spring of FIG. 5*a* having a rectangular shape.

The magazine spring 13 is formed (according to the invention) such that it is normally oval (see FIGS. 5*c*, 5*e*) or rectangular (see FIG. 5*d*, 5*f*) in shape but properly made in order to reduce the amount of space it occupies longitudinally. The magazine spring 13 is tapered (see FIG. 5*b*) and is preferably provided with reinforced coils (i.e. with a variable configuration) with stiffening folds 13*c* on each of the sides 100 and 102 (see FIG. 5*a*). This increases the thrust force and allows wider pitches compared with the traditional springs. The magazine spring 13 may also have two rectangular or oval sections: an upper section 104 with some coils narrower than the coils of the lower section 106. The magazine spring 13 is further provided with a smaller number of coils but longer pitch so as to contain the full length of the magazine spring when it is fully compressed.

The tube or magazine housing 11 is provided with a flat surface F formed such that it is cut off from the sharp edge of the guide ribs in the upper part of the tube or magazine housing 11 (tapered area). Such guide ribs have otherwise been found to be one of the causes of cartridge case scoring. This flat surface F also enables the ammunition to travel from the bottom of the rectangular shape of the magazine tube to the tapered part of the magazine tube by the guiding ribs without jamming or slowing down.

Figure 1:
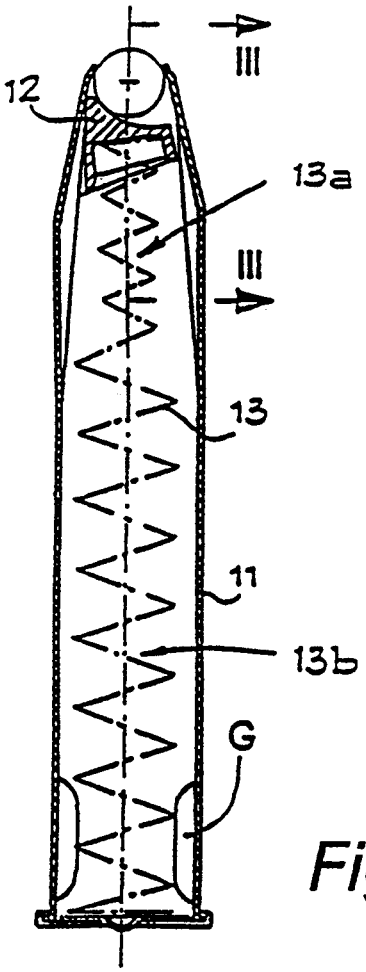
FIG. 1 is a lengthwise and cross view of the empty magazine according to the invention.
Figure 3:
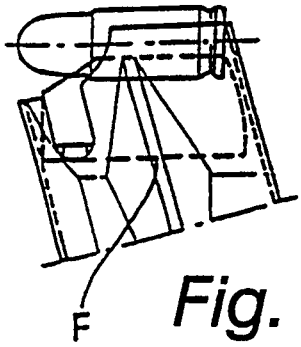
FIG. 3 is a partial view of the magazine according to arrows III—III in FIG. 1.

Two convex projections G (shown in phantom) are normally present on the two larger sides at the base of the magazine as shown in FIG. 1. These projections G normally have the job of centering the spring. According to the invention, the projections G have been removed. As the spring 13 has been widened and it is self-centers in the magazine tube 11. This provides additional space inside the tube.

The invention described herein has increased by two rounds the capacity of a double-row 9 mm PARA caliber 15-round magazine which makes a 15-round magazine and a 17-round magazine of the same length fully interchangeable.

By adopting the same new principles described above the capacity has been improved in proportion to the volumes on magazines of various calibers as well as on different portable handguns.

What is claimed is:

1. A magazine for firearms with cartridges, for use with automatic or semi-automatic pistols, the magazine comprising: a magazine housing for ammunition having a magazine housing bottom; a follower and spring provided within said magazine housing for moving the cartridges upward away frown the bottom, the follower including a curved upper edge with a radius larger than a radius of the cartridges, said curved upper edge connecting with a curved top tapered edge of the follower to form an inclined upper side, said follower having a base with an inclined surface and a cavity for receiving coils of the spring, a wall of said cavity and said inclined upper side meeting at an edge of said inclined surface at a beveled region, said spring having an upper tapered part fit into said cavity of said follower when the magazine is fully loaded with cartridges.

2. A magazine as in claim 1, in wherein said follower top edge defines means for reducing lateral thrust of cartridges at an inside of the magazine during loading and feeding and for enabling a reduction of space consumed by said follower inside of the magazine.

3. A magazine as in claim 1 wherein said follower top tapered edge defines means for guiding said follower over a change of an inside section of said magazine housing and for maintaining said follower in a rotational position in order to prevent it from jamming when the magazine is being loaded or unloaded.

4. A magazine as in claim 1 wherein said follower inclined surface which slope downwards from a side of the follower under said curved upper edge to said edge of said inclined surface.

5. A magazine as in claim 1 wherein said follower has a notch at said base, housing some coils of said tapered spring, duly oriented to enable the spring to exert its thrust action against the ammunition row over the follower along its vertical stroke.

6. A magazine as in claim 1 wherein said follower has a catch projecting laterally that interacts with a slide-stop lever and a bevel to enable the spring to self-center.

7. A magazine as in claim 1 wherein said spring has an oval or rectangular shape, and means for reducing an amount of space it occupies longitudinally, including:

a) a tapered spring structure with reinforced coils having stiffening folds made on sides to increase the thrust force and with a wide pitch;

b) two rectangular or oval sections: an upper one with some coils narrower than the coils of the lower one;

c) a smaller number of coils but longer pitch so as to contain the full length of the spring when it is fully compressed.

8. A magazine as in claim 1, wherein said magazine housing includes a flat surface cut off from a sharp edge of guide ribs formed in an upper part of said magazine housing to make easier the transit of ammunition from adjacent said base of said magazine housing with a rectangular section, to a top tapered area of said magazine housing.

9. A magazine as in claim 1, wherein an interior of said magazine housing is free of inwardly directed projections to enable the follower and the spring to use all the space available inside the tube.

* * * * *